United States Patent [19]

Perrine

[11] 4,026,731

[45] May 31, 1977

[54] METHOD FOR HEAT TREATING WIRE

[75] Inventor: Ralph J. Perrine, Salem, Ohio

[73] Assignee: The Electric Furnace Company, Salem, Ohio

[22] Filed: May 14, 1975

[21] Appl. No.: 577,353

Related U.S. Application Data

[60] Division of Ser. No. 467,254, May 6, 1974, abandoned, which is a continuation-in-part of Ser. No. 166,826, July 28, 1971, abandoned.

[52] U.S. Cl. ..... 148/134; 148/16; 148/16.7; 148/153; 148/155; 148/156; 148/157

[51] Int. Cl.[2] ..... C21D 1/18

[58] Field of Search ..... 148/155, 156, 16, 16.7, 148/20.3, 134, 143, 153, 157

[56] References Cited

UNITED STATES PATENTS

| | | | |
|---|---|---|---|
| 3,231,432 | 1/1966 | McLean et al. | 148/143 |
| 3,390,871 | 7/1968 | McLean et al. | 148/156 |

*Primary Examiner*—R. Dean

*Attorney, Agent, or Firm*—Meyer, Tilberry & Body

[57] ABSTRACT

Cooling by a gas coolant of carbon steel wire coils which have been heated to above the austenizing temperature of the wire is controlled to rapidly quench cool the wire coils to within a selected critical range of temperatures which results in a desired fine pearlitic crystalline structure of the steel wire, by controlling the impingement pattern and velocity of the coolant gas on the wire. The coolant gas is discharged through individual coolant gas inlet conduits, thence through a plurality of individual enclosed plenum boxes, onto the heated coils as the coils are transported past the boxes by a conveyor device. Each plenum box has a series of gas-discharge slots formed in the bottom thereof, through which slots the gas is discharged onto the coils. The distance between the discharge slots of each box and the wire coils may be selectively adjusted by raising or lowering individual ones of the plenum boxes relative to the level of the wire coils on the conveyor device. The coolant gas flow through each plenum box may be individually adjusted by flow control valves in the coolant gas inlet conduits.

4 Claims, 10 Drawing Figures

106
112
110
114
76
102
100
80
108
107
104
98
82
156
57
56
18
162
23
154
150
152
D
25
5
72
76
84
54
64
52
46
132
122
120
32
124
33
30
116
31
66
142
146
35
4
134
106
98
102
82
100
78
144
74A
C

METHOD FOR HEAT TREATING WIRE

This application is a division of co-pending patent application Ser. No. 467,254, filed May 6, 1974, abandoned which in turn is a continuation-in-part application to patent application Ser. No. 166,826, filed July 28, 1971, now abandoned.

The present invention pertains to the art of heat treating, and more particularly to heat treating of steel wire having a medium to high carbon content. Wire, particularly steel wire, is commonly heat treated to adjust its metallurgical properties so that it will have high ductility and strength, and may be cold worked by drawing the wire to filament size having an extremely high tensile strength. Heat treating of medium or high carbon steel wire involves heating the wire to a critical upper temperature at or above its austenizing temperature, and then rapidly cooling (quenching) the heated wire to within a temperature zone at which the desired crystalline structure will be formed. The wire must be held within this temperature zone for a period of time sufficient to permit crystalline structure to be completed. The particular temperature zone involved (which may be referred to as the "transformation temperaure zone") depends upon the carbon content of the steel and the properties required in the finished product. Wire which has been treated by such a process is commonly called patented wire, the process being referred to as "patenting".

Steel wire which is to be subjected to the patenting process is usually of medium to high carbon content. Such wire usually contains a very course structure of pearlite which is of irregular formation, and makes the wire unsuitable for cold drawing. The patenting process improves the metallurgical structure of the wire for cold drawing by first heating the wire to or above a temperature high enough to place the carbon into solid solution in the iron and then rapidly cooling the wire to a temperature at which the carbon precipitates out of solution in the form of closely spaced, very fine plates of iron carbide. The patenting process provides a wire of metallurgical structure which combines high tensile strength with high ductility, so that the wire is able to withstand reduction in diameter by drawing. Cold working on the wire by drawing to a smaller diameter further increases its tensile strength. However, the presence of scattered brittle spots in the wire make it unsuitable for cold working by drawing to smaller diameters. Such brittle spots are often caused by the presence of hard pieces of pro-eutectoid ferrite or carbide.

In the typical patenting process, the wire is heated to above an upper critical temperature, which is usually the austenizing temperature, in order to cause the carbon to go into solid solution in the iron. The wire is then rapidly cooled to a temperature within a temperature zone, which may be referred to as the transformation temperature zone, in which zone there is a rapid transformation to a desired fine pearlitic structure in plain carbon steels. Rapid cooling of the wire from the austenizing temperature down to the transformation temperature zone supresses the formation of pro-eutectoid ferrite on the surface layers of the wire. If the wire is not cooled sufficiently and the temperature stays above the transformation zone, the pearlitic structure will be too coarse. If the wire is cooled to below the transformation temperature zone, the center of the rod may be of the proper fine pearlitic structure, but the surface will be acicular or bainitic. Cooling to an even lower temperature can produce definite hardening by the formation of sorbite or martensite. Such hardening greatly impairs the ability of the wire to be drawn to smaller diameters. As previously stated, the rate of cooling from the high austenizing temperature to a temperature within the transformation temperature zone must be high, i.e., the cooling must be rapid, in order to supress the formation of pro-eutectoid ferrite on the surface layers of the wire. After rapid cooling to (or slightly below) the transformation temperature zone, the wire must be held at (or reheated to) a temperature within the transformation temperature zone in order to obtain isothermal transformation of the wire to at least one of upper bainite and fine pearlite structures while avoiding the formation of pro-eutectoid products. This allows the carbon to come out of solution slowly so that a fine pearlitic structure is obtained. The wire must be held within the desired transformation temperature zone for a sufficient length of time to effect complete transformation. If the wire is not rapidly cooled from the austenizing temperature to a point at, or slightly below, the transformation temperature zone, network ferrite may form in the surface layers of the wire and formation of pro-eutectoid products is promoted.

In early patenting processes, wire was heated to a temperature above the upper critical temperature and then fed through a lead or salt bath for rapid cooling. Rapid cooling of the heated wire from an elevated temperature to one within a narrow, desired transformation temperature zone is a very critical step in the patenting process. A lead or salt bath may easily be maintained at a desired temperature at, or slightly below, the transformation temperature zone of the wire so that proper rapid cooling of the wire is achieved. However, lead or salt clings to the wire and the wire must be further processed to remove such material from the surface thereof. In addition, it is possible to feed wire through such a bath only in a longitudinal strand and not in coiled or loop form.

Coiling or looping the wire greatly increases the capacity of a given production line and is a well known expedient. For example, U.S. Pat. Nos. 3,056,433 (Haugwitz) and 3,103,237 (Crum; reissued as Re. 26,052) show the handling of wire in processing operations by forming it into loops or coils.

U.S. Pat. Nos. 3,574,000 (Geipel et al.) and 3,615,083 (Feinman et al.) show the utilization of fluidized beds to provide a medium for controlled rapid cooling of coiled wire rod. In particular, U.S. Pat. No. 3,615,083 shows a coil wire rod being quench cooled in a two-zone fluidized bed of silica sand.

While it is obviously disadvantageous in terms of initial plant investment cost and operating expenses to have to maintain a molten lead or salt bath or fluidized bed for cooling, the prior art generally held to the view that an air or other gas coolant operation could only provide an inferior product, due to the difficulty of controlling the rate of cooling when using gas coolants, U.S. Pat. No. 3,615,083, is typical of much of the prior art in this regard, showing in the Table at Columns 3–4 the result of tests indicating the generally unsatisfactory product obtained in gas cooling in the wire patenting process.

Other patenting processes include those described in British Pat. No. 624,545 and German Pat. No. 738,928. In the patenting process described by these patents, the wire is heated above the upper critical temperature and is then air quenched to a temperature at, or slightly below, the transformation temperature zone by circulating a cooling gas over the wire at high velocity. In the process described by these two patents, the wire is still fed in a longitudinal strand through the heating and cooling zones. As aforesaid, the production rate of patented wire when feeding it in a single strand through the various zones is very low and this renders production of the wire by such a procedure very uneconomical.

Other arrangements for heat treating wire to obtain desirable metallurgical properties include those described in British Pat. No. 1,071,315, and U.S. Pat. Nos. 3,231,432 and 3,390,871, both to McLean et al. In the process described in these patents, rod is fed directly from a rod rolling mill to a device which forms the rod into successive coils which are deposited in spaced-apart overlapping relationship on a conveyor. Although coiling the wire permits a high production rate, the wire must be water cooled to below the upper critical temperature before it can be formed into successive loops. In these patents, the rod is cooled immediately upon leaving the rod rolling mill, by passing it longitudinally through a water cooling device, down to a temperature between the upper critical temperature and the transformation temperature zone. Cooling the rod to a temperature between the upper critical temperature and the desired transformation temperature zone for a period of time long enough to permit it to be formed into successive loops, promotes the formation of large pieces of pro-eutectoid ferrite, or carbide and network ferrite, in the surface layers. As previously explained, formation of such structures is undesirable because it produces brittle spots in the finished rod. In the process described in these patents, the rod also cools further by radiant cooling while it is being formed into successive coils and being deposited on the conveyor. This radiant cooling in the air also promotes formation of pro-eutectoid ferrite on the surface layers of the wire.

Nonetheless, the teaching particularly of the McLean U.S. Pat. No. 3,390,871 is of interest in the attempt to utilize gas coolant cooling of the wire rod and in providing a perforated floor through which the gas coolant is forced to impinge upon the coiled wire rod to be cooled. McLean, particularly in FIGS. 7 and 8 thereof, shows a perforated floor wherein generally a larger perforation area is contained along the edges of the floor than in the center in order to impinge a greater quantity of air upon the overlapped sides of the coils (as compared to the center). There is a greater concentration of metal per unit area at the edges of the coil than at the center. But this approach requires changing the floor openings for different sizes and types of wire rod to be cooled, since no one pattern of coolant gas entry ports can give good results for a wide variety of wire size and type.

The successful wire patenting apparatus and method of the present invention is the result of research and experimentation carried out to develop a gas quench method which would provide patenting results at least comparable to those attainable by molten salt or molten lead quench methods. Early tests showed that in attempting to jet cool looped wire coils with a coolant gas, non-uniform cooling of the wire coils by the jet of coolant gas was the major source of non-uniformity of tensile strengths along the length of the wire.

FIG. 2A of the drawing shows a schematic plan view of a typical looped coil of wire as it is passed through the jet cooler. The wire is divided by the crossed dotted lines into, respectively, front, back, left, and right sections 12*a*, 12*b*, 12*c*, and 12*d*, as sensed facing in the direction of material travel indicated by the arrow 23. Generally, it was found that with a substantially uniform discharge of coolant gas on the looped coils, the left hand and right hand segments 12*c* and 12*d* were not cooled as much as the front and back segments 12*a* and 12*b*, due to the bunching up or overlapping of the left hand and right hand coil segments as indicated schematically in FIG. 2, and described in more detail hereinbelow.

A continuous development program tried numerous expedients in order to attain sufficiently rapid and uniform cooling. The utilization of a constant volume of coolant gas delivery in conjunction with numerous types of baffles, slotted jet plates, etc. generally was unsuccessful in attaining sufficiently rapid uniform cooling. Employing larger or more numerous gas discharge openings adjacent the overlapped left hand and right hand coil segments 12*c* and 12*d* to direct more of the gas flow on the overlapped segment of the coils provided some improvement, although undesirably high variations in tested segments of the wire persisted. Slowing up the rate of wire travel along the conveyor system to obtain a greater degree of cooling in the jet chamber, resulted in too great a time lag between exit from the heating furnace and entry into the jet cooling chamber, with resultant premature slow cooling. This had the adverse effect of forming pro-eutectoid spots on the wire.

Utilization of a variable speed, high capacity blower to permit control of the delivery rate of coolant gas, and a soaking furnace immediately after the jet cooling chamber showed promise as providing an apparatus and method for obtaining the desired results with a coolant gas.

But even with the use of a high cooling capacity jet cooling chamber and a soaking furnace positioned immediately adjacent thereto, the problem of nonuniformity of results along segments of the loop of wire persisted, particularly when it was desired to provide an apparatus and method capable of treating different diameter wires. That is, while a given apparatus and gas discharge port pattern might provide reasonably consistent and uniform results for a smaller diameter wire such as 0.035 inches diameter, undesirably low average tensile strengths or variations along the looped segments in tensile strength would occur when a heavier wire such as a 0.1313 inch diameter wire was treated in the same equipment.

No one of the many combinations of baffles, jet plate gas discharge port designs and sizes provided sufficient control over the discharged jets of coolant gas to provide uniform quench cooling for a wide variety of wire sizes.

OBJECTS OF THE INVENTION

It is accordingly an object of the present invention to provide a wire patenting apparatus and method wherein a gas coolant (e.g., air) is employed to attain controlled rapid cooling and temperature maintenance of the wire rod to provide sufficient temperature control to yield the desired metallurgical crystalline structure for a wide variety of wire sizes and types.

It is another object of the invention to provide a wire patenting method wherein air cooling or gas cooling is used exclusively, and the need for liquid coolant, molten salt or lead of fluidized bed coolants is eliminated.

It is another object of the invention to provide a wire patenting method wherein a simpler, less expensive plant design is required by virtue of the fact that solely gas coolant is employed, which nonetheless yields temperature control over a wide variety of wire rod sizes which are treated in looped coil form, the temperature control of the process being sufficiently precise to yield wire patenting results at least as good as those obtainable heretofore only by molten lead, salt or fluidized bed processes.

It is another object of the present invention to provide an improved apparatus and method for making patented wire which apparatus and method is more economical than methods and apparatus heretofore available and which process yields a patented wire which is highly ductile and has a high tensile strength.

SUMMARY OF THE INVENTION

In accordance with the invention, there is provided a jet cooling chamber within which coiled wire rods are to be cooled. The chamber includes a plurality of individual plenum boxes, each of which is connected to a source of coolant gas. Each plenum box has one or more gas discharge ports therein and is adjustable with respect to the distance between the discharge ports and the coiled wire rods being cooled.

In accordance with one aspect of the invention, each plenum box is adjustably mounted so that its position relative to the jet cooling chamber and relative to the transport surface of a conveyor system within the jet cooling chamber may be selectively adjusted, the wire rods to be cooled being supported upon and transported by the transport surface of the conveyor system.

In accordance with another aspect of the invention, the coolant gas flow is controlled by flow-control means which may include valves located in coolant gas inlet conduits connected in gas-flow communication to each of the plenum boxes.

In accordance with another aspect of the invention, the coolant gas is flowed through the individual plenum boxes and associated gas discharge ports. The rate of gas flow through, and the position of, each plenum box is controlled so as to assure uniform cooling along the entire length of the looped coils. Those plenum boxes adjacent the more overlapped segments of the looped coils preferably have coolant gas flowed therethrough at a greater rate and/or positioned closer to the coils than the other plenum boxes.

In accordance with another aspect of the invention, a soaking furnace is positioned immediately adjacent the discharge end of the jet cooling chamber and receives therein the wire cooled in the cooling chamber. Preferably, the soaking furnace is contiguous with the jet cooling chamber, a common "party wall" forming both the discharge end wall of the jet cooling chamber and the entry end wall of the soaking furnace.

Coolant gas supply means provides coolant gas to the jet cooling chamber and may include gas-inlet conduits connected to the plenum boxes, a coolant gas manifold to which the inlet conduits are connected, a variable speed blower means to flow coolant gas through the system, coolant gas return means to conduct coolant gas heated by the wire from the jet cooling chamber to the blower, and coolant gas heat exchange means to cool the heated coolant gas.

Generally, the plenum boxes are arranged within the jet cooling chamber in a row transversely across the path of travel of the wire material to be cooled by coolant gas discharged from the plenum boxes. The plenum box at each end of the row is generally positioned at the outer periphery of the line of travel of the widest material to be cooled thereunder.

A conveyor apparatus, e.g., rollers, conveyor belt or the like, has a transport surface upon which the heated wire is supported and conveyed through the jet cooling chamber (and through the other equipment associated therewith).

Plenum box adjustable mounting means are attached to at least one plenum box, preferably to at least the two end plenum boxes and most preferably to all the plenum boxes. The adjustable plenum box mounting means permits selective adjustment of the distance between the gas discharge ports of the plenum boxes equipped therewith and the conveyor apparatus transport surface, and thereby the wire to be cooled.

BRIEF DESCRIPTION OF THE DRAWINGS

The invention may take form in certain parts and arrangement of parts, a preferred embodiment of which will be described in detail as follows and illustrated in the accompanying drawings, which form a part hereof and wherein.

DESCRIPTION OF THE PREFERRED EMBODIMENT

Figure 1:
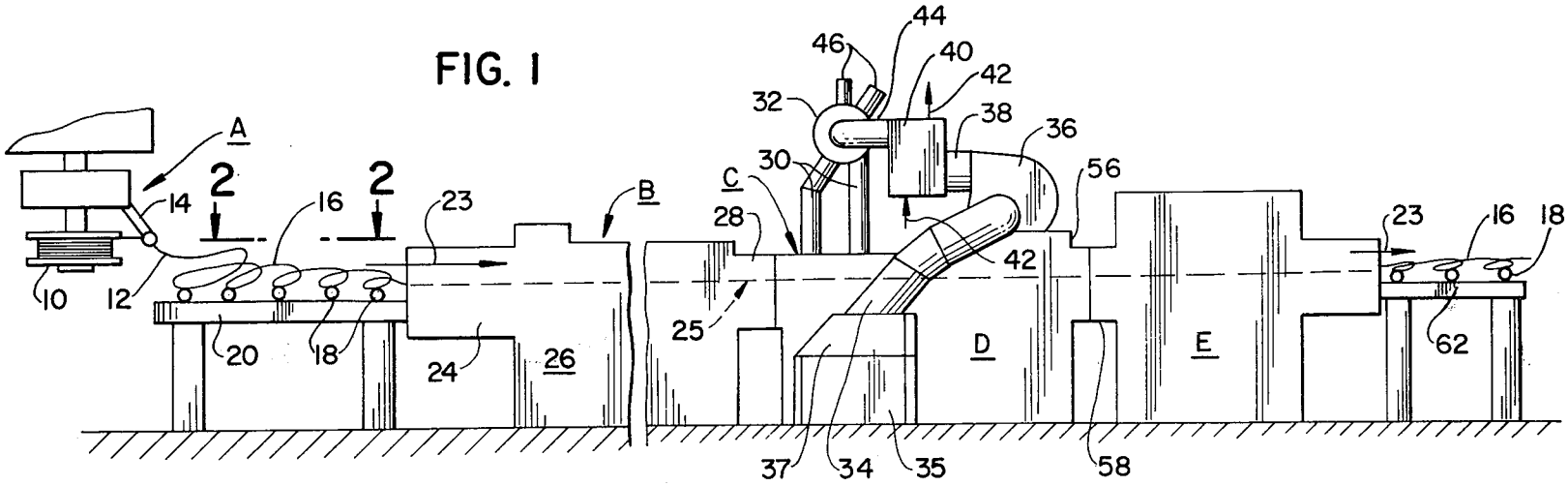
FIG. 1 is a side elevation schematic view of a production line for making patented wire in accordance with the present invention.

Referring now to the drawings, wherein the showings are for purposes of illustrating a preferred embodiment of the invention only and not for purposes of limiting the same, FIG. 1 shows a production line for the patenting of wire in loop form. A wire loop forming means generally designated A includes a storage reel 10 from which a continuous length of wire 12 is fed to a loop forming device 14 which may be any suitable one of the known devices for forming wire rod into continuous loops or coils. One such device is described in U.S. Pat.

Figure 2:
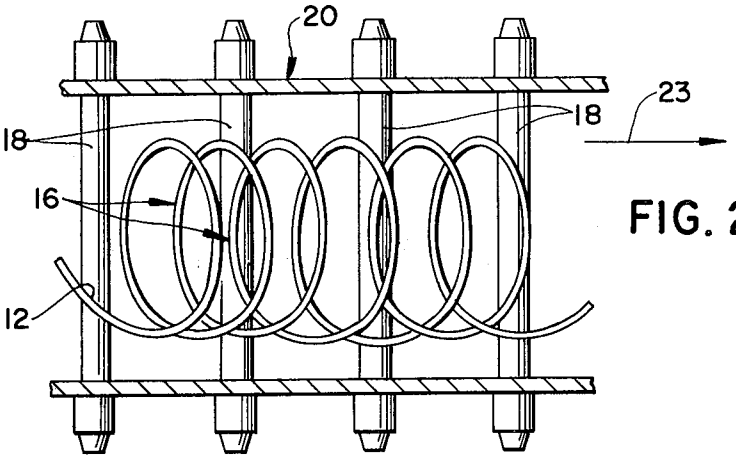
FIG. 2 is a schematic plan view taken along lines 2—2 of FIG. 1, showing the continuous wire formed into looped coils.
Figure 2A:
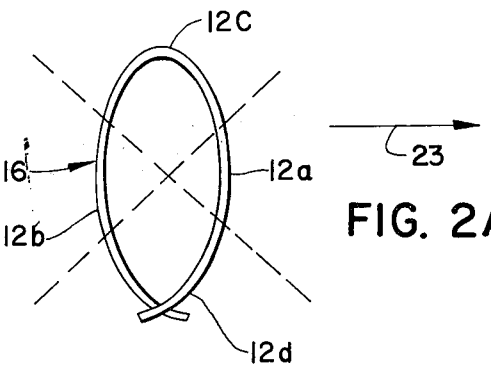
FIG. 2A is a schematic plan view of one of the looped coils of FIG. 2.

No. 3,061,229 to Crum. Loop forming device 14 forms wire 12 into successive loops 16 which are fed onto loop entrance table 20. A typical loop pattern is shown in FIG. 2. Loop entrance table 20 is supplied with rollers 18 (or any other suitable conveyor means) over which the continuous successive loops of wire 16 travel in the direction shown by the arrows 23 in FIG. 1 into main heating furnace B. A conveyor apparatus 25 is generally indicated by the dotted line passing through the equipment of FIG. 1, which dotted line schematically indicates the wire transport surface of conveyor apparatus 25. In this embodiment, conveyor apparatus 25 essentially consists of a series of driven rollers 18.

An atmosphere sealed entrance vestibule 24 connects the discharge end of loop entrance table 20 to main heating furnace B. Conveyor 25 moves successive loops 16 through each of the items of equipment in the production line shown in FIG. 1. Main heating furnace B may be any suitable furnace, usually gas or electrically fired, as is known in the art for heating the successive loops 16 of wire 12 to a temperature which may be described as the upper critical or austenizing temperature thereof. For a wire of the following typical composition, this temperature is between 1,700° to 1,750° F, and allows the carbon in wire 12 to go into solid solution in the iron.

A typical composition of wire employed in patenting process is as follows:

| | WEIGHT PERCENT |
|---|---|
| Carbon | 0.65–0.75 |
| Manganese | 0.50–0.80 |
| Phosphorus | 0.035 |
| Sulphur | 0.035 |
| Silicon | 0.15–0.30 |
| Iron | Balance |

As is known in the art, main heating furnace B may be supplied with a protective atmosphere in place of air.

Main heating furnace B has a discharge end 28 from which emerges the heated successive loops 16 of wire 12. Positioned immediately adjacent discharge end 28 of Furnace B is an adjustable jet cooler C. The overlapping heated loops 16 of wire 12 are still at their austenizing temperature when they enter jet cooler C. That is, overlapping loops 16 of wire 12 are not allowed to cool below the upper critical temperature or austenizing temperature of wire 12 before entering jet cooler C.

Coolant gas inlet conduits 30 lead from a coolant gas manifold 32 to adjustable jet cooler C wherein wire 12 is cooled by the gas.

After being used to cool wire 12, the heated coolant gas is conducted via outlet chamber 35, tapered hood 37 and gas return flue 34 from jet cooler C to a blower 36. Blower 36 forces the gas via a duct 38 to a gas-liquid heat exchanger 40. Within heat exchanger 40, the heated coolant gas is cooled by a liquid cooling medium, the passage of which through heat exchanger 40 is indicated by the arrows 42. The cooled coolant gas then passes via manifold inlet 44 to coolant gas manifold 32, from which it begins another cycle.

It will be recognized that the heat exchanger cooling of the gas coolant required to achieve proper cooling of wire 12 will depend upon its velocity through adjustable jet cooler C and the travel velocity of overlapped loops 16 of wire 12 on conveyor system 25.

Control valve housings 46 are mounted on manifold 32, and are described in more detail hereinbelow.

In one example of the operation of an embodiment of the invention, wire 12 has a diameter of about 0.035 inches and travels in the direction of the arrows 23 on conveyor system 25 at a velocity of about 15 feet per minute. The coolant gas forced through adjustable jet cooler C comprises a mixture of hydrogen, carbon monoxide, and nitrogen, although it will be recognized that air or other gases may be employed as the coolant. In this example, the coolant gas is forced into the jet cooler C at a volumetric flow rate of about 50 cubic feet per second and a temperature of about 120° F so that overlapped loops 16 of wire 12 are rapidly cooled to a temperature at, or somewhat below, the transformation temperature zone of wire 12. The subcooling to below the transformation temperature zone helps to allow for internal heating caused by the exothermic nature of the transformation to desired pearlitic structure.

As previously explained, extremely rapid cooling of wire 12 from the upper critical temperature thereof to or below the transformation temperature zone is extremely important to prevent formation of undesirable metallurgical structures in wire 12 and to freeze the carbon in solution in the iron. Cooling is accomplished at a sufficiently fast rate to preclude formation of proeutectoid ferrite and to obtain fine pearlite. The time involved in cooling will vary of course, depending on the diameter of the wire and its composition.

For the wire described in the foregoing example, jet cooler C cools wire 12 from its austenizing temperature of about 1700°–1750° F to its transformation temperature of about 800°–850° F in about 3 seconds. The discharge end of jet cooler C is positioned contiguously to the inlet end of soaking furnace D. Soaking furnace D may be heated by any suitable means such as electricity or gas, and may have a protective atmosphere maintained therein if so desired, as is well known in the art. Soaking furnace D is heated so as to heat wire 12 to, and to maintain wire 12 at, a temperature within the desired transformation temperature zone thereof. For the wire described, this soaking temperature is around 900°–1000° F. The length of soaking furnace D is taken into consideration in the design of the equipment in order to maintain wire 12 at the soaking temperature for a period of between about 8 to 20 seconds, so that the carbon may come out of solution in the form of closely spaced, very fine particles of iron carbide, to yield a very fine pearlitic structure. Wire 12 will then have a high tensile strength and high ductility with no brittle spots. The length of time for which a given wire 12 is held at the soaking temperature will likewise depend upon the composition thereof, particularly its carbon content.

In any event, wire 12 is held at the soaking temperature long enough to obtain complete transformation and preclude formation of martensite. The ductility of wire 12 is lost if the temperature drops down into the martensitic range before the formation of fine pearlite is completed.

Overlapped loops 16 of wire 12 exit from discharge end 56 of soaking furnace D and may then be conveyed through enclosed passageway 58 to a final cooler E, within which the successive loops 16 of wire 12 may cool at a less stringently controlled rate. Since the desired transformation to a particular metallurgical species, i.e., fine pearlite, has already been accomplished, the cooling rate in final cooler E is not critical. The cooled wire 12 emerges through discharge end 60 of final cooler E onto loop discharge table 62. Loop discharge table 62 is equipped, in a manner similar to loop entrance table 20, with conveyor rollers 18. From this point, the patented, cooled wire may be transported to take-up reels or other processing steps, such as pickling, coating, etc. as is well known in the art.

Alternatively, final cooler E may be dispensed with and successive loops 16 may, upon emerging from soaking furnace D, be air cooled to ambient temperature or fed through a water bath for rapid cooling to ambient temperature.

Patented wire is normally further processed as by drawing wire 12 to a reduced diameter which drawing cold works wire 12 so that it will have an extremely high tensile strength.

Figures 3, 9:
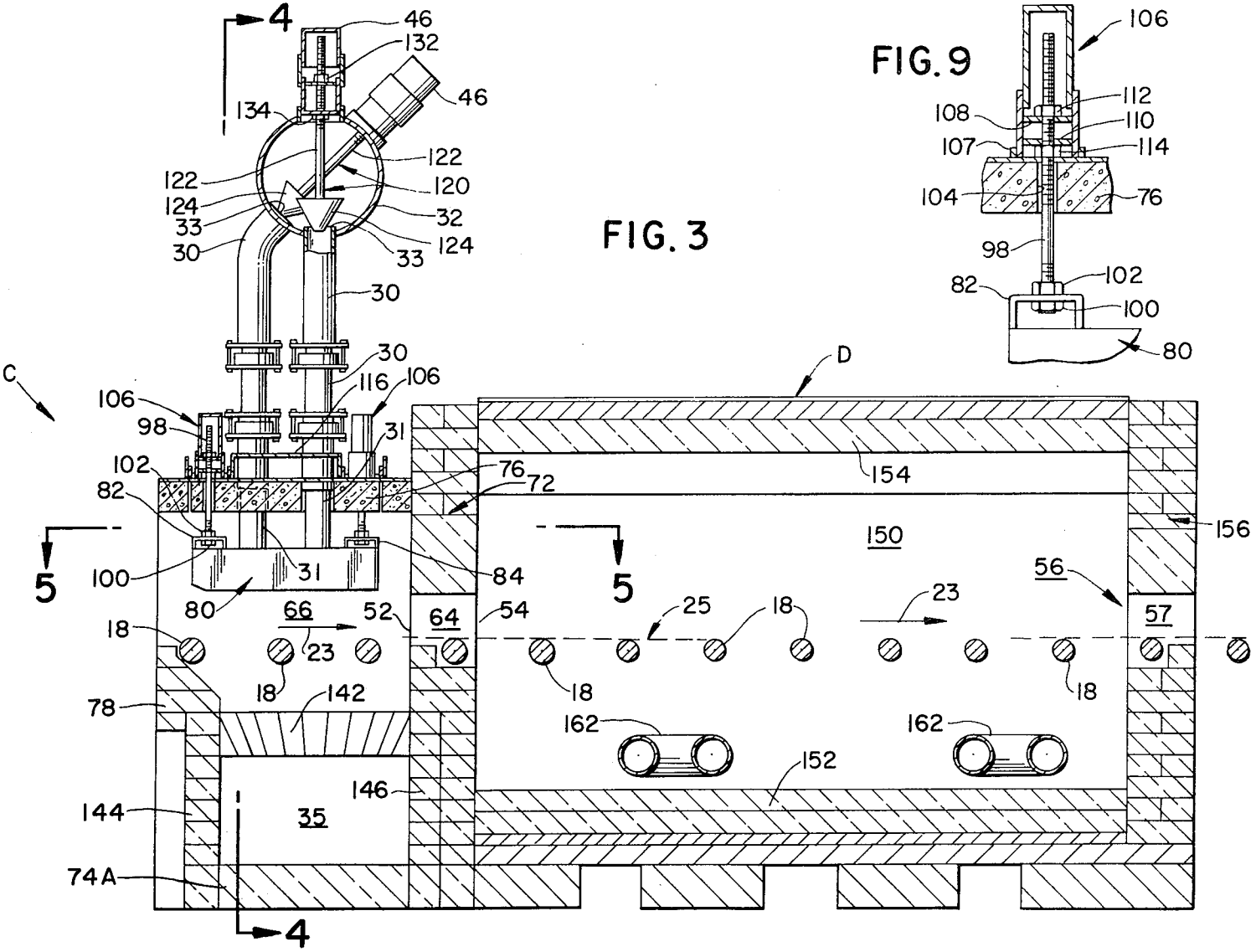
FIG. 3 is a side elevation view with parts broken away for clarity of illustration, of a jet cooler and an associated soaking furnace utilized in the production line of FIG. 1, FIG. 3 being taken along section line 3—3 of FIG. 4.
FIG. 9 is an enlarged view of a segment of the furnace of FIG. 3.

Referring now to FIG. 3, adjustable jet cooler C and soaking furnace D are shown in side elevation view. Discharge end 52 of cooler C is interconnected to inlet end 54 of furnace D by a passageway 64 through which rollers 18 provide a continuous pathway for successive loops 16 of wire 12 (not shown in FIG. 3) as indicated by arrows 23 in FIG. 3. A jet chamber 66 is formed within jet cooler C by substantially vertical side walls 68, 70 (FIG. 4), end wall 72, floor 74, roof 76 and inlet end wall 78.

Figure 4:
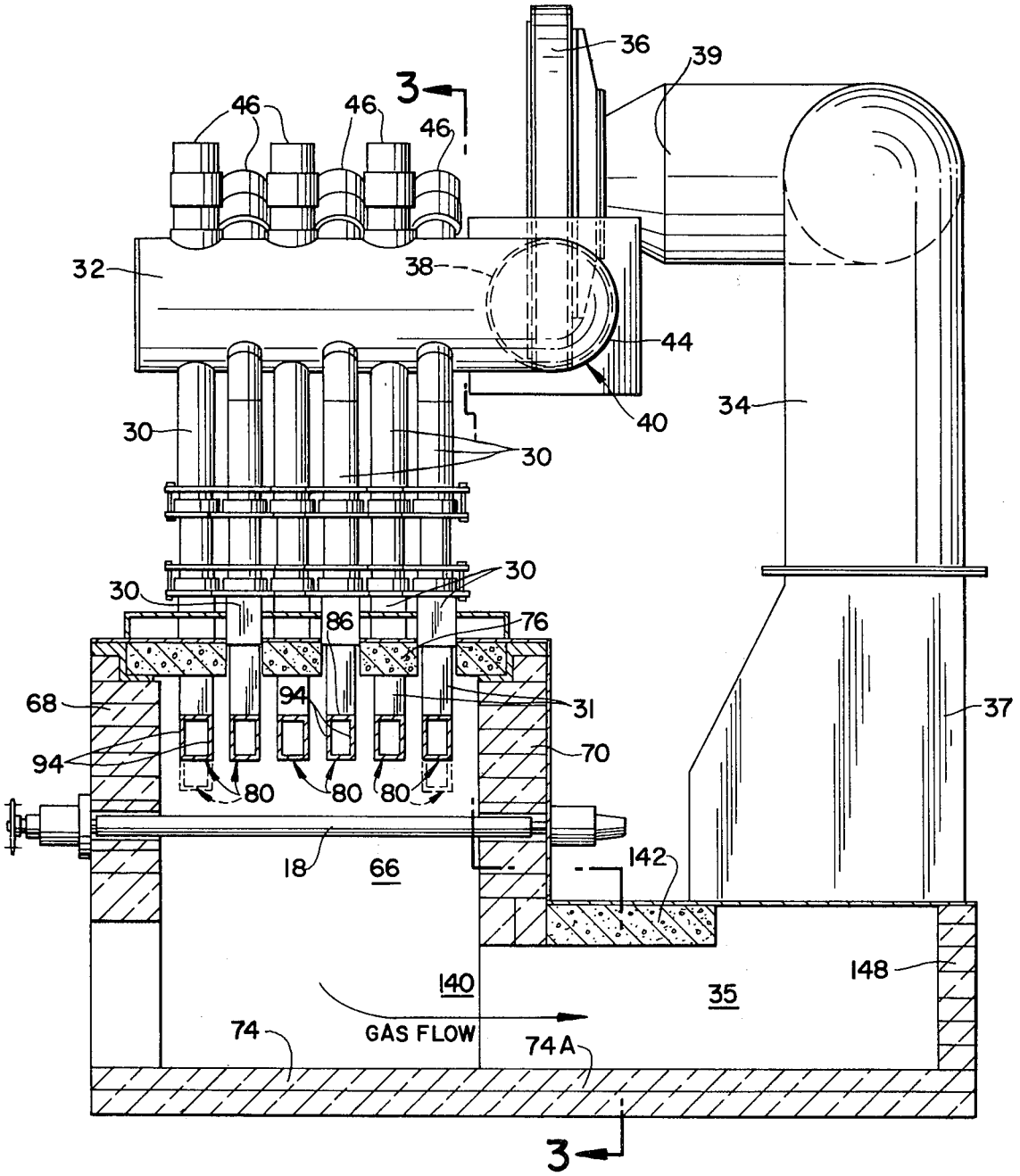
FIG. 4 is an end elevation view taken along section line 4—4 of FIG. 3, with parts broken away for clarity of illustration.

Suspended within jet chamber 66 are a plurality of enclosed plenum boxes 80. As best seen in FIG. 4, six identical plenum boxes 80 are arranged in substantially parallel alignment with respect to each other and with respect to the direction of wire 12 material travel through jet chamber 66, the longitudinal axis of each plenum chamber being substantially parallel to the direction of material travel.

FIG. 4 best shows a typical driven roller 18, over which successive loops 16 of wire 12 are conveyed through the equipment.

Figure 7:
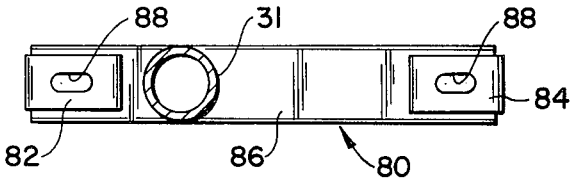
FIG. 7 is a plan view taken along section line 7—7 of FIG. 6.
Figure 6:
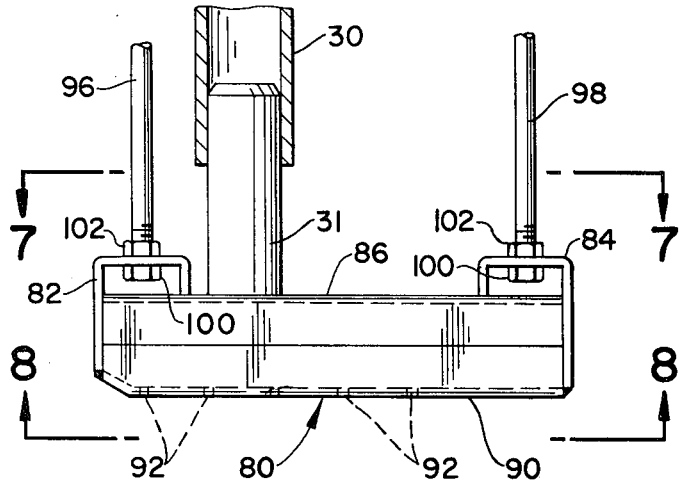
FIG. 6 is an enlarged side view in elevation of one of the plenum chambers shown in FIG. 3.
Figure 8:
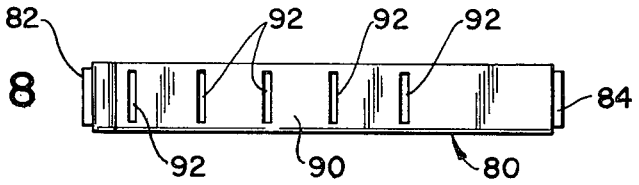
FIG. 8 is a plan view taken along section line 8—8 of FIG. 6.

The construction of plenum boxes 80 is best seen with reference to FIGS. 6, 7, and 8 which show plenum boxes 80 to be substantially rectangular in overall configuration, and to have a front bracket 82 and a rear bracket 84 mounted, respectively, at the front and rear ends of plenum boxes 80, and extending over the top portions 86 thereof. A mounting hole 88 is formed in each bracket 84, 86. Each plenum box 80 is connected in gas flow communication to a coolant gas inlet conduit 30 by a conduit connector 31. Each conduit connector 31 enters its respective plenum box 80 through the top portion 86 thereof.

As shown in FIG. 8, the bottom plate 90 of plenum box 80 contains therein a plurality of rectangular gas discharge ports 92 arranged along a portion of the longitudinal extent of bottom plate 90, and centered on the portion of bottom plate 90 which is opposite the point where conduit connector 31 enters plenum box 80. These gas discharge ports in the bottom plates of the plenum boxes may be rectangular orifices as shown, or they may be round, oval, slotted, x-shaped or have any other suitable shape. As best seen with respect to FIG. 5, the location of conduit connector 31 with respect to its associated plenum box 80 is staggered between alternate plenum boxes 80, so that one plenum box has its associated conduit connector 31 near the front end thereof, and the adjacent plenum box is connected to its associated conduit connector 3 near the rear end thereof. In each case, slots 92 in bottom plate 90 are disposed therein substantially centered with respect to the entry point of conduit connector 31 into top portion 86.

As best seen in FIG. 4, plenum boxes 80 are generally rectangular in cross section, bottom plates 90 and top portions 86 being of substantially the same width, with side walls 94 being formed therebetween.

As best seen with respect to FIGS. 3 and 6, each plenum box 80 is supported by a pair of vertical adjusting rods 96, 98 connected, respectively, to front brackets 82 and rear brackets 84 by means of nuts 100, 102, the lowermost ends of vertical adjusting rods 96, 98 being threaded for this purpose.

Vertical adjusting rods 96, 98 extend upwardly (FIG. 9) through passageways 104 formed in roof 76 of jet chamber 66 and into adjusting rod housings 106. Vertical adjusting rods 96, 98 are supported within rod housings 106 by transverse mounting plates 108, 110, which have holes (unumbered) formed therein through which holes vertical adjusting rods 96, 98 respectively pass. Adjusting rods 96, 98 are secured to transverse mounting plates 108, 110 by fastening nuts 112, 114.

Adjustable rod housing 106 is threaded into a receiving lip 107 embedded in the top of roof 76 to form generally cylindrical gas-tight enclosure about passageways 104 and vertical adjusting rods 96, 98. The threaded construction of housing 106 permits rapid disassembly thereof in order to provide access to fastening nuts 112, 114 when it is desired to raise or lower the plenum boxes as described in detail hereinbelow.

A conduit housing 116 is secured to the uppermost portion of roof 76 to provide a gas-tight seal about the entry of coolant gas conduits 30 into roof 76.

Each coolant gas inlet conduit 30 is connected to a conduit connector portion 31 (FIGS. 3 and 4) which is telescopically mounted within conduit 30 (FIG. 6) in order to accomodate the raising and lowering of plenum boxes 80.

As best seen in FIG. 3, the uppermost portion of coolant gas inlet conduits 30 are connected in gas flow communication with coolant gas manifold 32.

Within coolant gas manifold 32 are mounted a plurality of gas control valves 120, essentially consisting of a valve stem 122 and a generally cone-shaped gate portion 124. The upper portion of valve stem 122 (which essentially comprises a threaded shaft) has a threaded portion 126 extending along a substantial portion of its upper end. Threaded portion 126 of stem 122 is received within a control valve housing 46. A pair of transverse mounting plates 128, 130 having suitable holes formed therein are secured to valve housing 46 to admit the threaded portion 126 of stem 122 therethrough. Fastening nuts 132, 134 secure stem 122 within control valve housing 46 in a manner generally similar to that utilized in securing adjustable rods 96, 98 within respective rod housings 106.

Control valve housing 46 is formed in threaded sections to facilitate disassembly for adjusting the valves as described hereinbelow. The lowermost section of valve housing 46 is threadably received in a gastight relationship to inlet gas manifold 32.

Cone shaped gates 124 are positioned by their respective valve stems 122 in alignment with the uppermost edges of conduits 30, which upper most edges project into manifold 32 and serve as the seats 33 of gas control valves 120.

By adjusting the position of valve stem 122 relative to its housing 46, gates 124 may be seated more deeply into the seats 33 to reduce the flow of gas therethrough into conduits 30, or gates 124 may be withdrawn from seats 33 to increase the effective size of the gas flow opening into gas conduits 30, thereby increasing the flow of coolant gas therethrough.

Referring now to FIG. 4, floor 74 of jet chamber 66 is seen to have an extension 74 A which extends into a cooling gas outlet chamber 35. Cooling gas outlet chamber 35 is formed between a segment of floor 74A, a roof section 142, outlet side walls 144, 146 (FIG. 3) and end wall 148.

Gas return flue 34 is positioned in gas flow communication with gas outlet chamber 35 by means of tapered hood 37. Gas return flue 34 is connected in gas flow communication with blower 36 by blower inlet flue 39.

Duct 38 connects the outlet of blower 36 to a gas-liquid heat exchanger 40 from which a manifold inlet 44 conducts the gas, cooled within heat exchanger 40 by indirect heat exchange with a coolant liquid, into coolant gas manifold 32.

The cooled gas flows from heat exchanger 40 to manifold 32, past valves 120 into conduits 30, then through lower portion 31 thereof into plenum boxes 80 and outwardly therefrom in a controlled pattern over successive loops 16 of wire 12, and into jet chamber 66. From there, the gas emerges through cooling gas outlet section 140 into outlet chamber 35.

The coolant gas flow rate is controlled by the setting of blower 36 and valves 120, its temperature by the liquid coolant temperature and flow rate through heat exchanger 40, and its dispersal pattern by the height setting of plenum boxes 80.

Figure 5:
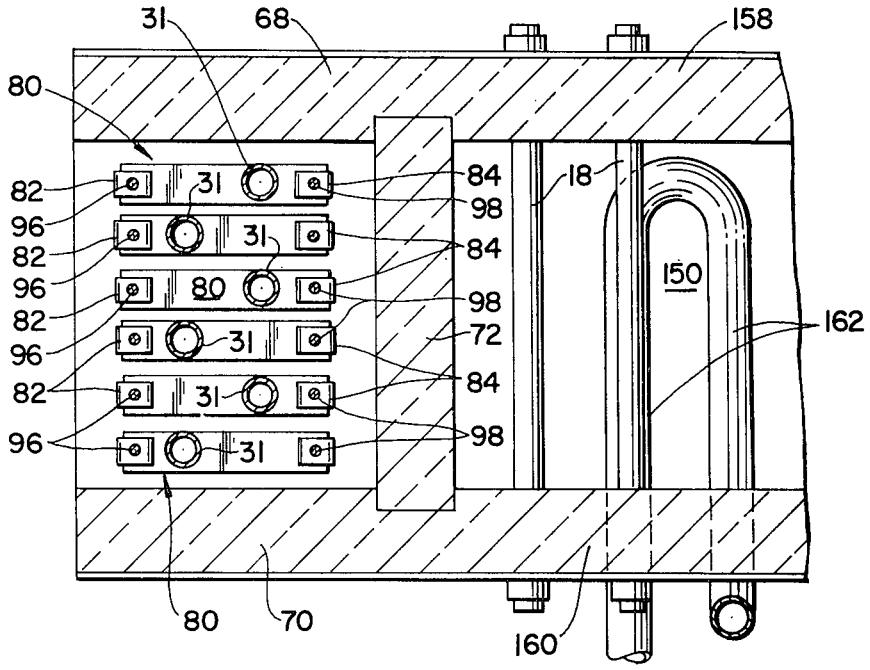
FIG. 5 is a partial plan view taken along section line 5—5 of FIG. 3, with parts broken away for clarity of illustration.

Referring now once again to FIG. 3, soaking furnace D is seen to be contiguous with adjustable jet cooler C, driven rollers 18 disposed therein defining a conveyor path 25 therethrough. Soaking chamber 150 is generally rectangular in configuration and is formed by floor 152, roof 154, discharge end wall 156, and wall 72 (which is a "party wall" between jet chamber 66 and soaking chamber 150) and side walls 158, 160 (FIG. 5). A throat opening 57 is formed in the discharge end 56 of soaking furnace D through which successive loops 16 of wire 12 emerge on drive rollers 18.

Disposed along the length of soaking chamber 150 are a plurality of heating U-tubes 162 which may be employed, in the known manner, to heat soaking furnace D to maintain the required temperature therein for treating the wire as hereinabove described. Electrical, gas fired, or any other suitable mode of heating may be employed.

In operation, successive loops 16 of wire 12 (not shown in FIGS. 3 or 4) are conveyed at a suitable speed through main heating furnace B (FIG. 1) wherein they are heated to a critical upper temperature. The heated loops 16 of wire 12 are then conveyed via rollers 18 into jet chamber 66 wherein coolant gas expelled through slots 92 of bottomplate 90 impinges on the heated loops of wire to rapidly cool the wire to a controlled temperature by transfer of heat to the coolant gas. The height of each plenum box 80 above the looped wire material passing beneath it may be adjusted to a desired, preselected height prior to commencing operation by removing the vertical adjustment rod housing 106, loosening fastening nuts 112, adjusting the rods 96, 98 to the desired position, retightening fastening nuts 112 and then replacing adjustable rod housing 106.

Thus, the proximity of the gas outlet slots 92 to the wire 12 to be cooled may be varied as desired along selected portions of the looped pattern of the wire.

Generally, the plenum boxes adjacent the more overlapped portions of the looped coils will be placed closer to the coils than the plenum boxes adjacent the more open, i.e., less overlapped, portion of the looped coils. Those plenum boxes thus positioned with their discharge ports closer to the coils naturally have a greater cooling effect thereon than do the more remotely positioned plenum boxes. The enhanced cooling effect accommodates the greater metal mass per unit volume existing at the more overlapped portion of the looped coils, and the tendency of the overlapped coils to shield each other from the coolant gas, thereby effecting more uniform over-all cooling. Accordingly, although the drawings show all plenum boxes positioned at the same level, in practice, some at least of the plenum boxes may be positioned at different levels from each other. This as indicated by the dotted line rendition of the end plenum boxes in FIG. 4.

With blower 36 at a predetermined setting, the coolant gas flow through each individual plenum box 80 may be controlled by an appropriate setting of gas control valves 120. Gas control valves 120 are set with respect to each individual gas inlet conduit 30 in a manner similar to that employed in adjusting vertical adjusting rods 96, 98. That is, prior to commencing operation, control valve housing 46 may be removed, fastening nuts 132, loosened, and valve stem 122 positioned to place valve gate 124 at an appropriate position relative to seat 33 formed by the uppermost end of gas inlet conduits 30.

Generally, the coolant gas flow rate is greater in the plenum boxes adjacent the more overlapped portions of the looped coils. Increased coolant gas flow through these plenum boxes may be utilized in addition to, or in lieu of, the closer positioning of these plenum boxes to the coils.

Adverting to FIG. 2, it is seen that the looped coils are transported in a row and are overalapped to the greatest extent at the outer edges of the coil mass parallel to the direction of the material travel as indicated by arrow 23. The inner portion of the looped coils is more "open", i.e., there is less overlapping. The drawing is schematic and in practice the coils may be formed into a considerably tighter, more overlapped pattern than that shown. Accordingly, in practice, the plenum boxes at each end of the transverse (to the direction of wire travel) row of plenum boxes are generally positioned closer to the looped coils than are the plenum boxes in the interior of the transverse row. The boxes may be stepped, the distance of the plenum boxes and their associated gas discharge ports from the looped coils decreasing from the center towards the end boxes of the transverse row. Those boxes which are positioned closer to the looped coils generally have the higher coolant gas flow rate therethrough. The more overlapped edge portion of the row of looped coils is the "overlapped edges" and the interior, less overlapped portion is the "open portion " of the looped coils, as these terms are used in the claims.

By thus controlling the flow of coolant gas through each individual conduit and plenum box 80, and by controlling the height of each plenum box 80 above the wire being cooled, a preselected, precisely controlled pattern of coolant gas flow over the heated wire 12 of loops 16 may be obtained.

As the wire passes from jet chamber 66 into soaking chamber 150 of soaking furnace D, an appropriate soaking temperature is maintained during the course of the travel of the loops 16 of wire 12 through soaking chamber 150 by heat supply via U tubes 162 (or other suitable means) in the known manner.

Upon emerging from soaking chamber 150, the wire may be cooled either with a water quench, by ambient air cooling, or by cooling within an enclosed final cooler E, as shown in FIG. 1, in accordance with production requirements and needs of particular processes.

While the invention has been described in detail with reference to a specific embodiment thereof, it will be apparent to those skilled in the art upon a reading and understanding of the foregoing that numerous changes and modifications thereto may be made which are nonetheless within the spirit and scope of the claimed invention. It is intended to include all such modifications and alterations within the scope of the appended claims.

It will further be noted by those skilled in the art that numerous structural components, controls, safety features, valves, peepholes, etc. which are usual and conventional on furnaces of the type described, have been ommitted from the drawings and description for the sake of clarity and simplicity. In this regard, the drawings may be considered semi-schematic in nature.

Having thus described my invention, I claim:

1. The method of uniformly heat treating a non-uniform steel product having a portion of greater mass and a portion of lesser mass, said product having a known transformation temperature and a known interval of time in which transformation occurs, said method comprising the following steps:

a. heating said non-uniform product to an elevated austenizing temperature;

b. rapidly and uniformly cooling said non-uniform product to a lower temperature which is substantially below said transformation temperature by passing an amount of coolant gas over the portions of said non-uniform product of greater mass and by passing a proportionately lesser amount of coolant gas over the portions of said non-uniform product of lesser mass;

c. reheating said non-uniform product in a gaseous atmosphere until it is uniformly heated to said transformation temperature;

d. holding said non-uniform product at said transformation temperature for said known interval of time whereby transformation has occurred in said product; and, e. then allowing said product to continue to cool to a temperature substantially below said transformation temperature.

2. The method of claim 1, wherein the rate of flow of said coolant gas over said portions of said nonuniform product of greater mass is proportionately greater than the rate of flow of said coolant gas over said portions of said non-uniform product of lesser mass.

3. The method of claim 1, wherein the source of coolant gas passed over said portions of greater mass of said non-uniform product is positioned proportionately closer to said non-uniform product than the source of coolant gas passed over said portions of lesser mass of said non-uniform product.

4. A method of controlling the cooling cycle used in heat treating an elongated steel wire having a known transformation temperature zone from a first temperature substantially above said transformation temperature zone to a second temperature below said transformation temperature zone, said method comprising the steps of:

a. providing said wire as an elongated network of overlapping convolutions at said first temperature of which said wire network is essentially austenitic;

b. moving said network along a selected path and in a given direction;

c. cooling a gas to a temperature substantially below a third intermediate temperature, said third temperature being in said transformation temperature zone;

d. directing said gas against said moving wire network at a rate to cool said wire network to a temperature below said third temperature at a first preselected position on said selected path and before transformation of the austenite;

e. reheating said wire network in a gas atmosphere to said third temperature immediately after said wire network passes said first preselected position;

f. maintaining said wire network in said gas atmosphere at said third temperature until said wire network passes a second preselected position in said path, said second known position being spaced longitudinally from said preselected position in said given direction a distance to allow said network to pass through said transformation zone at said second position; and, g. allowing said wire network to cool to said second temperature after said transformation has been concluded and after said wire network passes said second preselected position.

* * * * *